United States Patent [19]

Machida et al.

[11] Patent Number: 4,555,695

[45] Date of Patent: Nov. 26, 1985

[54] FIRE ALARM SYSTEM

[75] Inventors: Haruchika Machida; Sadataka Yuchi, both of Sagamihara, Japan

[73] Assignee: Hochiki Kabushiki Kaisha, Tokyo, Japan

[21] Appl. No.: 611,437

[22] Filed: May 17, 1984

[30] Foreign Application Priority Data

May 19, 1983 [JP] Japan ..... 58-75145[U]
Sep. 20, 1983 [JP] Japan ..... 58-173701

[51] Int. Cl.[4] ..... G08B 1/08

[52] U.S. Cl. ..... 340/538; 340/505; 340/514; 340/518; 340/310 R; 340/584; 340/628

[58] Field of Search ..... 340/538, 531, 537, 510, 340/505, 506, 514, 512, 518, 584, 825.06, 825.07, 825.08, 825.09, 825.1, 825.54, 310 R, 628; 179/5 R, 5 P

[56] References Cited

U.S. PATENT DOCUMENTS 4,161,727 7/1979 Thilo et al. ..... 340/584
4,162,489 7/1979 Thilo et al. ..... 340/518
4,206,449 6/1980 Galvin et al. ..... 340/518
4,287,515 9/1981 Raber et al. ..... 340/584
4,404,548 9/1983 Muller et al. ..... 340/518
4,491,828 1/1985 Galvin et al. ..... 340/511
4,491,830 1/1985 Miyabe ..... 340/518

*Primary Examiner*—Donnie L. Crosland
*Attorney, Agent, or Firm*—Armstrong, Nikaido, Marmelstein & Kubovcik

[57] ABSTRACT

A fire alarm system having a plurality of fire detectors connected in parallel with each other to a pair of power/signal lines leading to a central signal station and adapted to respond to the signal station with a detection signal in the mode of current and controlling the signalling between the fire detectors and the signal station. The detection of a fire is accomplished by computing a difference between a steady-state current flowing through the signal lines and a detection current which are detected in an analog amounts. Each of the fire detectors is called by a simple calling clock pulse whose transmitting timing is controlled by a microcomputer of the central signal station to transmit a detection data. The generation timing of the calling clock pulses is freely selectable to effect a desired control of the fire detectors.

10 Claims, 18 Drawing Figures

FIRE ALARM SYSTEM

BACKGROUND OF THE INVENTION

1. Field of the Invention

This invention relates to a fire alarm system in which a plurality of fire detectors connected to a central signal station through a pair of signal lines are sequentially called to return detection signals in the mode of current from the detectors for determining a fire based on the returned detection signals.

2. Description of the Prior Art

In conventional fire alarm systems, the signalling between a plurality of fire detectors each including an analog detecting means for detecting, in the form of analog data, a change in the ambient physical phenomena caused by a fire and a central signal station is attained by calling the fire detectors from the signal station by code signals and responding thereto from the fire detectors also by the code signals. The code signals from the signal station comprise pulse codes for the respective fire detectors each of which is composed of an address bit, a response bit and a control bit. The signal station sequentially calls the respective fire detectors by transmitting pulse codes of different address bits and determines a fire if it receives a response any one of the fire detectors.

However, such conventional fire alarm systems are required to provide an expensive coding circuit for each of the fire detectors and they have another problem that if a plurality of types of fire detecting means are employed in the systems and the types of the detecting means are required to be identified, the number of bits required for call and response is increased and it takes considerable time for processing.

In another example of the conventional fire alarm system, the fire detectors are called by code signals and the detectors respond thereto in the form of a change in current amount. In this system, however, the signal station calls the fire detectors by palling and three lines such as a power line, a common line and a signal line are required. The number of the lines may be reduced to two and the signal line may be used in common with the common line. But, the respective detectors are considered to be inherent impedances and a current flows through the signal line or the common line in a normal monitoring condition. Therefore, if an oscillation circuit within the fire detector is energized or deenergized, the value of current is changed and the change is not distinguished from the signal. Thus, there may be caused a misoperation. There is another problem that when the number of the fire detectors is increased, the current flowing through the signal line is also increased. By this reason, there is a limitation in the number of the fire detectors connectable to a single central signal station. There is a further problem that a current consumed by the fire detector is increased when the fire detector is actuated upon detection of a fire and a S/N ratio of a detection signal to be returned to the signal station in the form of a change in a steady-state current is lowered.

As the examples of the relevant inventions known to the inventors, there can be mentioned U.S. Pat. No. 4,287,515 issued Sept. 1, 1981 to Samuel Raber, Allendale; John M. Wynne, Oak Ridge; Alan M. Heinm, Florham Park, all of N.J., U.S. Pat. No. 4,162,489 issued July 24, 1979 to Peer Thilo; Otto W. Moser, Berlin & Munich, Fed. Rep. of Germany, U.S. Pat. No. 4,161,727 issued July 17, 1979 to Peer Thilo; Otto W. Moser, Berlin & Munich, Fed. Rep. of Germany. But, all of these inventions do not solve the problems involved in the conventional fire alarm systems as mentioned above.

SUMMARY OF THE INVENTION

It is an object of the present invention to provide a fire alarm system which employs a pair of lines used as a power line, a common line and a signal line, is capable of connecting a desired number of fire detectors without being subjected to the limitation by a change in a current in the normal monitoring state and is capable of maintaining a required S/N ratio of a response signal from the fire detectors even if there is caused a change in the current flowing through the signal line.

It is another object of the present invention to provide a fire alarm system which is capable of carrying out control of calling, response and detection condition of plural fire detectors, control of an operation test of the system, and control of external equipments associated with the system in the form of transmission control by a simple pulse signal and is capable of reducing the transmission time very much.

It is a further object of the present invention to provide a fire alarm system which is capable of accomplishing sure and accurate fire detection even if different types of fire detecting means are mounted in the fire detectors.

In brief, the fire alarm system of the present invention comprises a plurality of fire detectors connected in parallel with each other to a pair of power/signal lines leading to a central signal station for detecting a change in the ambient physical phenomena caused by a fire and responding, when called or addressed by the signal station, to return a detection signal in the mode of current; a current detecting means for detecting a steady-state current flowing through the signal lines and a detection signal current transmitted from the called or addressed fire detector after calling the fire detector by a calling clock from the signal station; a computing means for computing a difference between the steady-state current and the detection signal current; and an alarm means for determining a fire based on the output value from the computing means to provide an alarm.

BRIEF DESCRIPTION OF THE DRAWINGS

FIG. 10(*b*) is a time chart showing an output of the detection signal representing a fire;

DETAILED DESCRIPTION OF THE INVENTION

The present invention is directed to a fire alarm system having a plurality of fire detectors connected to a pair of signal lines which is used also as power lines as described above.

Figure 1:
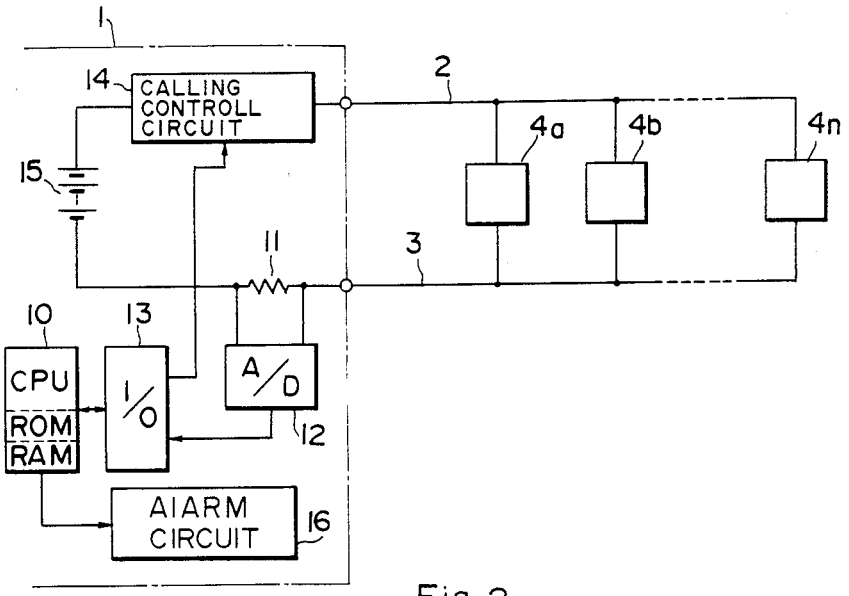
FIG. 1 is a block diagram of one embodiment of the present invention.
Figure 2:
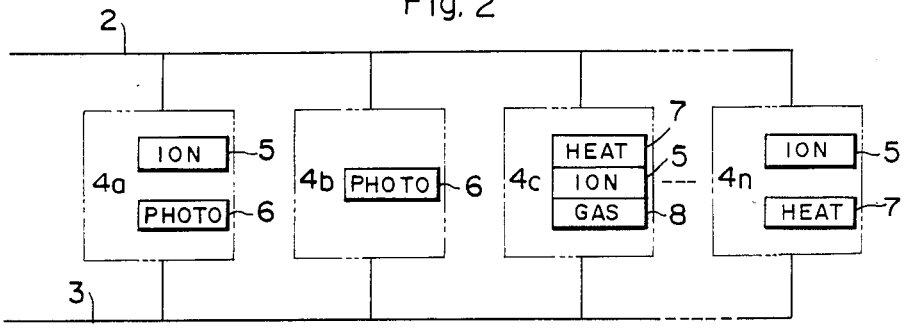
FIG. 2 is a block diagram showing fire detectors each including different types of detecting means.

At the outset, the construction of the system is described. In FIGS. 1 and 2, numeral 1 designates a central signal station from which a pair of power/signal lines 2, 3 are drawn out. A plurality of fire detectors 4*a* to 4*n* are connected in parallel with each other across the lines. Each of the fire detectors 4*a* to 4*n* has detecting means such as an ionization type smoke sensor 5, a photoelectric type smoke sensor 6, a heat sensor 7 and a gas sensor 8. When two or more detecting means are employed in the fire detectors 4*a* to 4*n*, the detection mechanism of the detecting means differ from each other. These detecting means each output an analog detection signal corresponding to the density of smoke, the temperature of heat and the density of gas, respectively.

Figure 10:
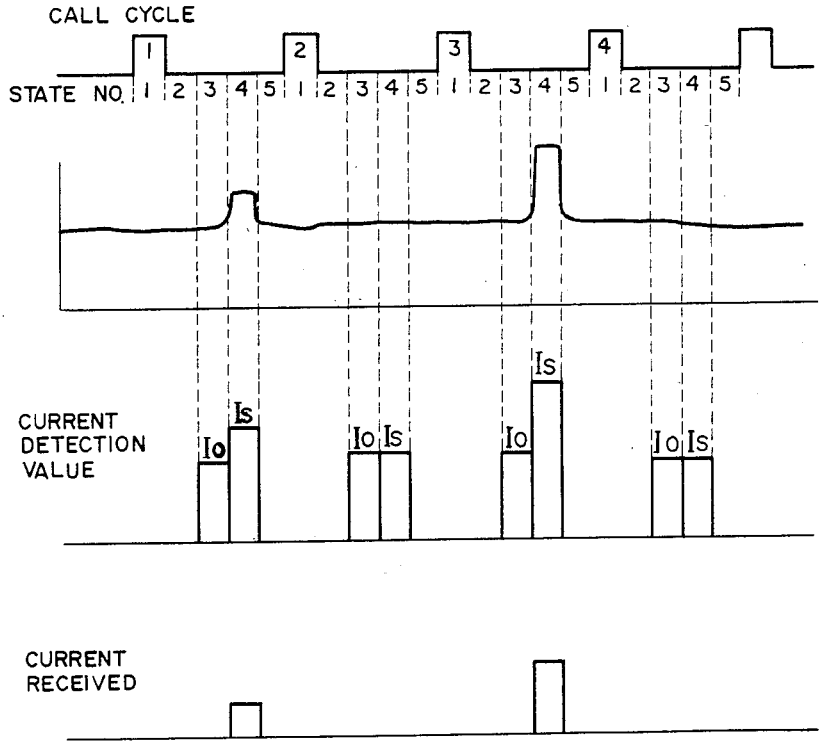
FIG. 10(*a*) is a time chart showing the detection of a signal current in the form of an analog form.
Figure 10:
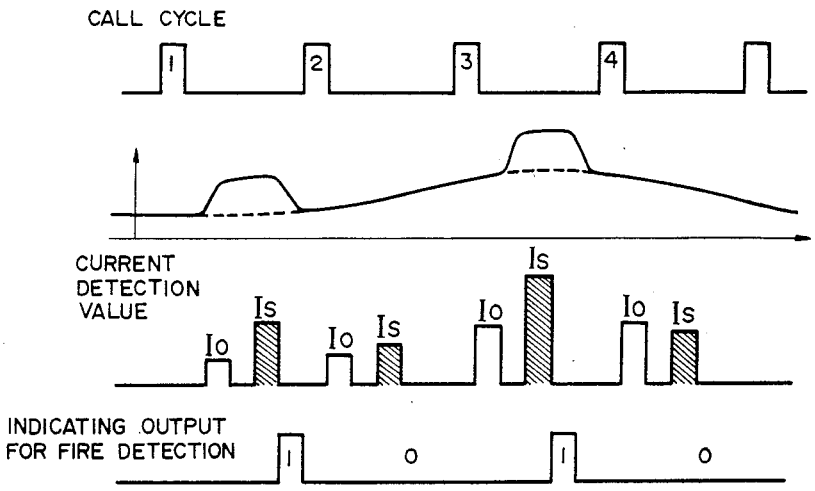
Figure 12:
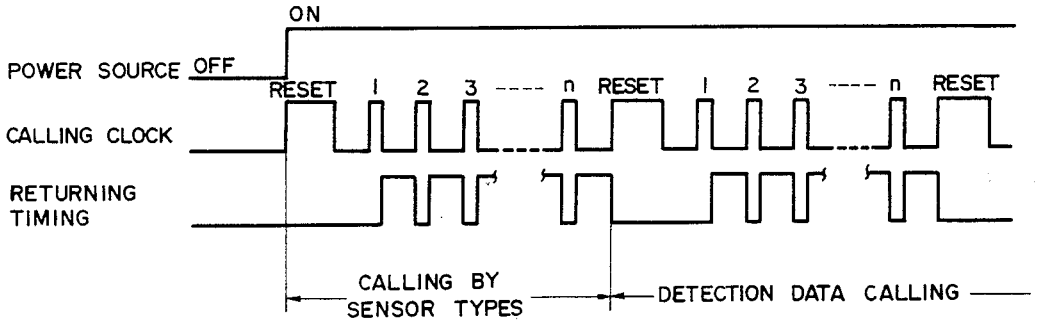
FIG. 12 is a time chart showing a relationship between the calling by sensor types and the calling of the detection data.

The formation of the central signal station 1 will now be described. The signal station 1 includes a microcomputer 10 as a controller for control of transmission and determination of a fire. In the figures, 11 is a resistor and 12 is an A/D converter which cooperate with the microcomputer 10 to constitute a current detection means. In the current detecting means, a current flowing through the signal line 3 in a steady state and a detection signal current returned from the respective detector 4*a* to 4*n* under control of the microcomputer 10 are detected and the detected analog values are converted into digital values and input to the microcomputer 10 through an interface 13. Numeral 14 is a calling control circuit which transmits reset pulses and calling clock pulses superposed on a power supply voltage to the respective fire detectors 4*a* to 4*n* under the control of the microcomputer 10 (refer to FIG. 8 and FIGS. 10(*a*) and (*b*)). In FIG. 1, 15 is a power supply and 16 is an alarm circuit.

Figure 3:
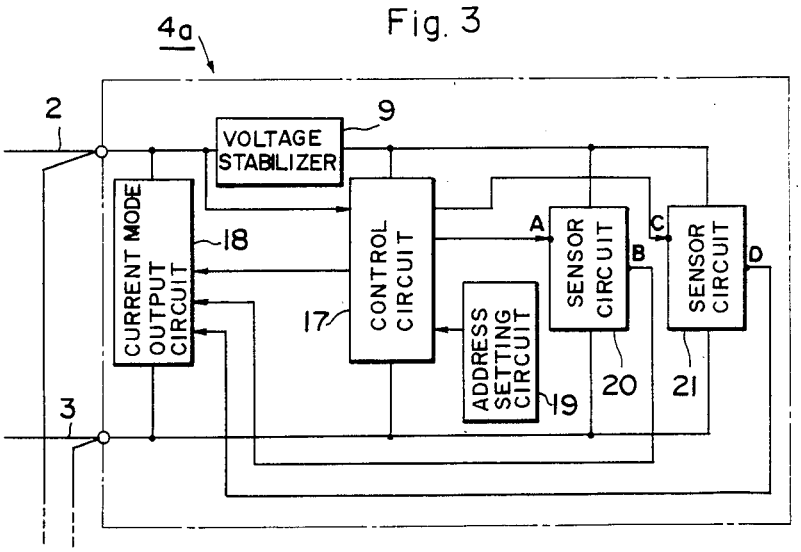
FIG. 3 is a block diagram of a circuit of each of the fire detectors.

The formation of the respective fire detector 4*a* to 4*n* will now be described. In FIG. 3, 17 is a control circuit which is a call determining means adapted to receive a reset pulse and a calling clock transmitted from the signal station 1 through the signal line 2 and recognize when it is called by counting the calling clock pulses. The control circuit 17 also functions as a transmitting means to transmit data by types of the sensors incorporated in the respective detector and detection data through a current mode output circuit 18 utilizing a free time between the calling clock pulses. The address of the respective control circuit 17 is set by an address setting circuit 19 and this address may be changed externally. In the figure, 9 is a voltage stabilizer.

Figure 4:
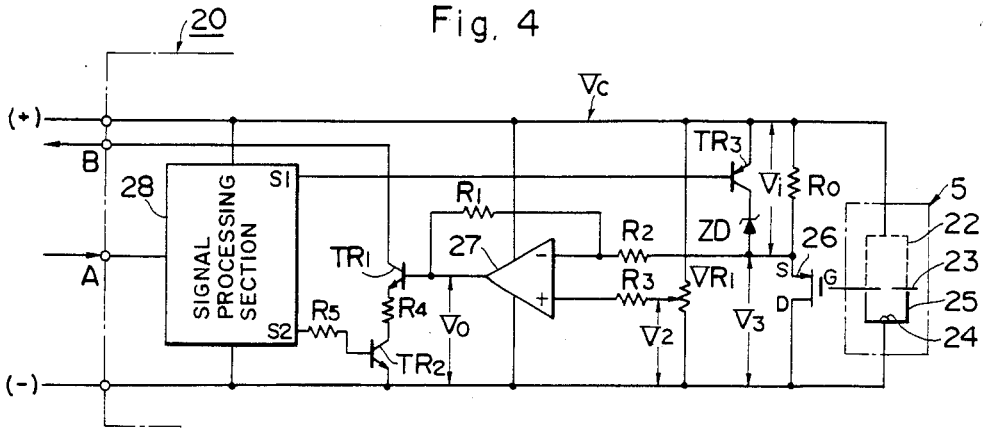
FIGS. 4 and 5 are electric circuit diagrams of a sensor circuit shown in FIG. 3.

20, 21 are sensor circuits which each include a detecting means. In the sensor circuit 20, for example an ionization type smoke sensor 5 is included as illustrated in FIG. 4 which comprises an external electrode 22, an intermediate electrode 23 and an internal electrode 25 having a radioactive radiation source 24. An FET 26 is connected to the intermediate electrode 23 and its conductivity degree is varied depending upon the density of smoke. The FET 26 is connected at the source S thereof to a load resistor $R_0$ and the source S is further connected to a negative input terminal of an operational amplifier 27. The negative input terminal is connected so that the output may be fed back through a resistor $R_1$. The input terminal of the operational amplifier 27 is applied with a set voltage of a variable resistor $VR_1$ through a resistor $R_3$. The output of the operational amplifier 27 is coupled to a base of a transistor $TR_1$ which is in turn coupled to a transistor $TR_2$ through a resistor $R_4$. The transistor $TR_2$ is connected to a signal processing section 28 so that a set signal for controlling the output of a detection signal may be supplied to the base of the transistor $TR_2$ from a terminal $S_2$ of the signal processing section 28 through a resistor $R_5$. The collector of the transistor $TR_1$ is coupled to the current mode output circuit 18 as illustrated in FIG. 3.

On the other hand, in order to output data by sensor types of the sensor circuit 20, a series circuit of a transistor $TR_3$ and a zener diode ZD is connected in parallel with the negative resistor $R_0$ so that a set signal for controlling the transmission of the data by sensor types is supplied to the base of the transistor $TR_3$ from a terminal $S_1$ of the signal processing section 28.

With such an arrangement of the sensor circuit 20, if the output voltage of the operational amplifier 27 is $V_0$, the set voltage of the variable resistor $VR_1$ is $V_2$ and the source voltage of the FET 26 is $V_3$, the signal by sensor types representing the ionization type smoke sensor 5 is supplied as the output voltage $V_0$ of the operational amplifier 27 as given by:

$$V_0=(V_2-V_3)\cdot(R_1/R_2)$$

Therefore, if the signal by sensor types is $V_0=0$, the variable resistor $VR_1$ is adjusted so that the voltage $V_2$ may be equal to the voltage $V_3$. By setting the signal by sensor types as $V_0=0$, signal processing section 28 outputs set signals from the terminals $S_1$ and $S_2$ thereof in response to the signal from the control circuit 17 when called from the central signal station and the circuit is set to constitute the condition of $V_0=0$ upon turning on of the transistor $TR_3$ by the set signal from the terminal $S_1$. Since the transistor $TR_2$ is rendered conductive by the set signal from the terminal $S_2$, the transistor $TR_1$ produces an output to the current mode output circuit 18 with the output from the operational amplifier 27 corresponding to the set signal by sensor types. Thus, the signal by types is transmitted.

Figure 5:
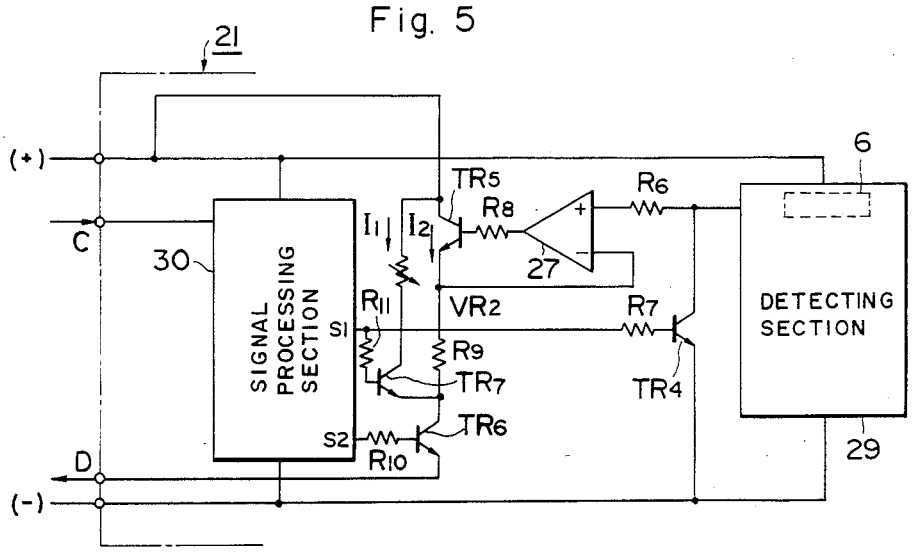

In FIG. 5, the sensor circuit 21 includes for example a photoelectric type smoke sensor 6 which is depicted as a detecting section 29 in the figure. This sensor circuit 21 has a signal processing section 30 similar to the signal processing section 28 in the circuit 20 of FIG. 4 and the detection output from the detecting section 29 is coupled to a positive input terminal of the operational amplifier 27 through a resistor $R_6$. The input side of the resistor $R_6$ is grounded through a transistor $TR_4$. The base of the transistor $TR_4$ is coupled to a terminal $S_1$ of the signal processing section 30 through a resistor $R_7$. The terminal $S_1$ outputs a set signal responsive to calling by types. The output of the operational amplifier 27 is connected to a base of a transistor $TR_5$ through a resistor $R_8$ and the emitter of the transistor $TR_5$ is connected in series to a transistor $TR_6$ through a resistor $R_9$. A terminal of the signal processing section 30 for outputting a set signal providing transmission timing of the data by types and detection data is connected to a base of the transistor $TR_6$ through a resistor $R_{10}$. A series circuit of the transistor $TR_5$ and the resistor $R_9$ is connected in parallel with a series circuit of a variable resistor $VR_2$ and a transistor $TR_7$. The base of the transistor $TR_7$ is connected to a terminal $S_1$ of the signal processing section 30 through a resistor $R_{11}$ so as to render the transistor $TR_7$ conductive by the set signal of calling by sensor types. The collector of the transistor $TR_5$ is connected to the current mode output circuit 18 as illustrated in FIG. 2.

The setting of the signal by sensor types in the sensor circuit 21 as illustrated in FIG. 5 is carried out by the variable resistor $VR_2$. More specifically, when calling by sensor types is received, the set signals are output from the terminals $S_1$ and $S_2$ of the signal processing section 30 and the input of the detection signal to the operational amplifier 27 is cutoff upon conducting of the transistor $TR_4$ to turn off the transistor $TR_5$. At the same time, the transistors $TR_6$ and $TR_7$ conduct to render a set current $I_1$ to flow through the variable resistor $VR_2$. The set current $I_1$ is transmitted to the current mode output circuit 18 as a signal by sensor types. On the other hand, in the calling of the detection data, the signal processing section 30 outputs a set signal only from the terminal $S_2$ to conduct the transistor $TR_6$. Since the transistors $TR_4$ and $TR_7$ are then in the non-conducting states, the detection current $I_2$ determined by the control of the transistor $TR_5$ by the output from the operational amplifier 27 is transmitted to the current mode output circuit 18.

Figure 6:
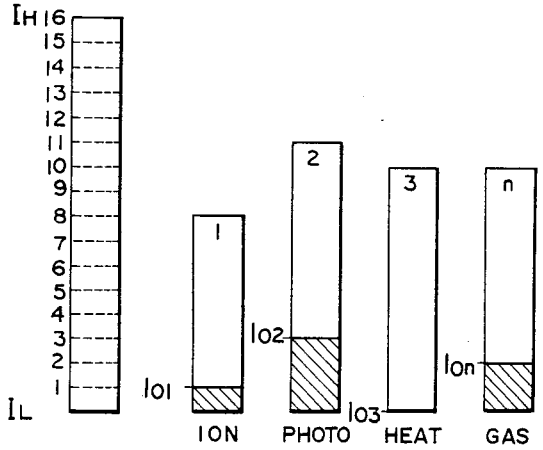
FIG. 6 is a graph showing levels of signal currents by sensor types.

Each of the remaining fire detectors similarly includes sensor circuits. The signals by sensor types which are transmitted from the sensor circuits 20 and 21 or other sensor circuits have current levels for example as shown in FIG. 6.

If the minimum and maximum values of the current transmitted from the respective detectors to the central signal station is assumed as $I_L$ and $I_H$, respectively, the range from $I_L$ to $I_H$ is divided into stages corresponding to the bit number of the digital processing in the signal station, e.g. 16 stages corresponding to the number of the digital processing, i.e., 4 bits, and the basic levels of current by sensor types are determined so as to differ in levels as shown by $I_{01}$ to $I_{0n}$ in the figure, corresponding to the types of the sensors, i.e. an ionization type smoke sensor, a photoelectric type smoke sensor, a heat sensor and a gas sensor. Thus, the detection currents by sensor types are preliminarily determined in the respective fire detectors so that the stages of the current may correspond to the detection mechanisms of the detecting means. Although the directions of the currents by sensor types and the detection current are opposite to each other at the output terminal B of the sensor circuit 20 and the output terminal D of the sensor circuit 21, the current signal by types and the detection current signal are adjusted to have the same direction so as to be detected in the current mode output circuit 18.

Figure 7:
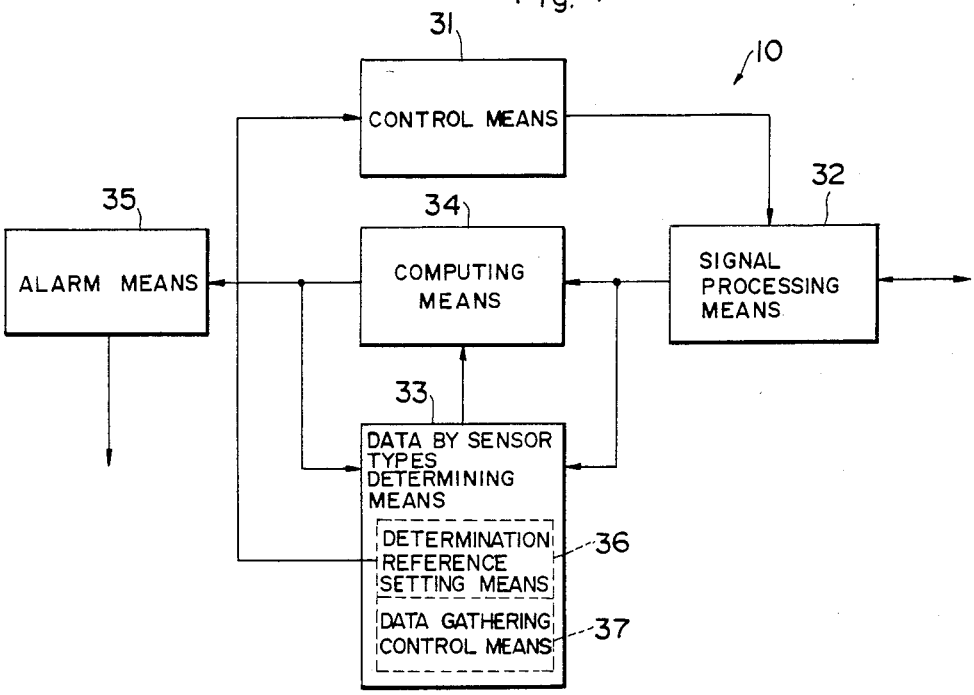
FIG. 7 is a block diagram showing various means included in a microcomputer of the signal station.

As illustrated in FIG. 7, the microcomputer 10 has a control means 31, a signal processing means 32, a data by sensor types determining means 33, a computing means 34 and an alarm means 35 as well as memories RAM and ROM.

Figure 8:
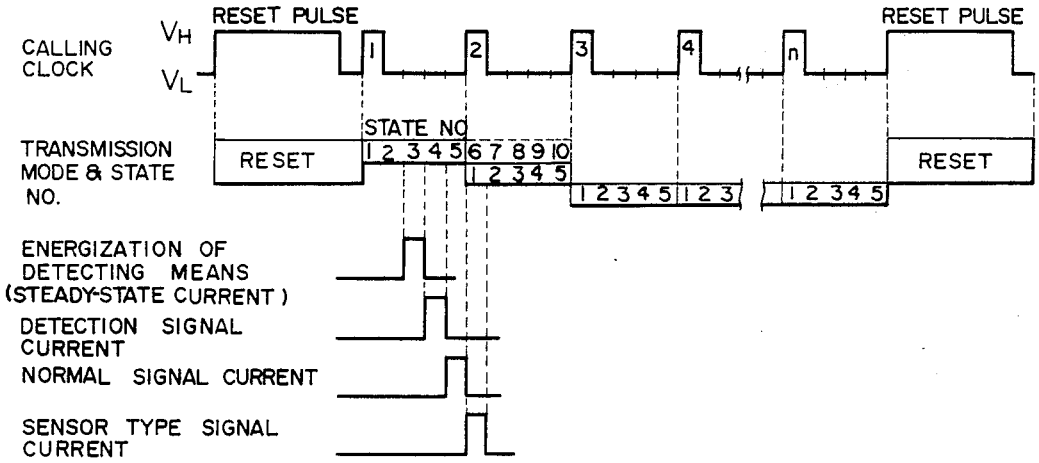
FIG. 8 is a time chart showing the relationship between a calling clock, transmission mode and state number.
Figure 9:
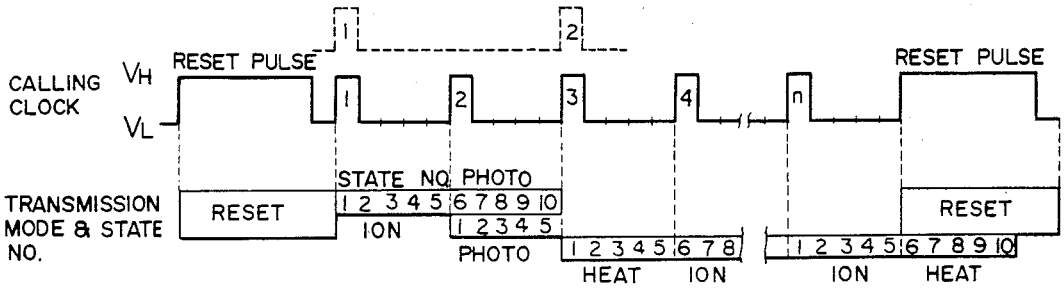
FIG. 9 is a time chart showing extra times provided between the calling clocks and allotted to the respective detecting means of the fire detector.

The control means 31 constitutes the calling control means in cooperation with the calling control circuit 14 and the signal processing means 32. The time interval between the reset pulses 1 to n is divided into a predetermined number of states as illustrated in FIG. 8. Upon application of a power source, in the respective fire detectors **4*a* to 4*n*, the detecting means is energized at state No. 3 (steady-state current), detection signal current is output at state No. 4, a normal signal current is output at state No. 5 and a signal current by sensor types is output at state No. 6. The signal current by sensor types at state No. 6 is first stored in the memory RAM. At this time, the detection at states Nos. 3 to 5 may be omitted, if desired. In the second cycle and thereafter, the next reset pulse is transmitted at the timing of state No. 6 unless otherwise required and the currents at the respective states Nos. 3 to 5 are detected. The signal processing means 32 outputs a control signal from the control means 31, i.e. a signal responsive to the calls for the data by sensor types or detection data to actuate the calling control circuit 14. The processing means 32 receives and processes the data by sensor types or detection data of the respective fire detectors 4*a* to 4*n* returned over the signal line 3 and the steady-state current flowing through the signal line 3**.

The information by sensor types determining means 33 comprises a determination reference setting means 36 which not only determines the sensor types and the number of the analog detecting means, i.e. sensors, in the respective fire detectors **4*a* to 4*n* from the contents of the received data by sensor types and the timing thereof but sets the determination reference for fire detection determination in the respective detecting means and a data gathering control means 37 which changes output timing of the calling clock pulses based on the determination of the number of the detecting means and the fire detection determination and adjust the free time between the calling clock pulses to control the data gathering from the respective fire detectors 4*a* to 4*n***. Thus, effective calling is attained to gather the detection data.

The computing means 34 carries out various computation based on the current values received by the signal processing means 32. More specifically, it effects comparing computation of the steady-state current value flowing through the signal line 3 and the signal current value by sensor types, comparing computation of the steady-state current value and the detection signal current value and so on. The computation result by the computing means 34 with respect to the signal current by sensor types is transmitted to the data by sensor types determining means 33 as data by sensor types.

The alarm means 35 determines a fire on the basis of the output value which is based on the computation of the computing means 34, i.e. the result of the comparing computation of the steady-state current value and the detection signal current value. This fire determination procedure will now be described referring to the signal waveforms of FIG. 10 in the form of reception and processing of the data by sensor types and the detection data. When the calling clock pulses are transmitted from the central signal station 1, the called fire detector **4*a* to 4*n* output the current by sensor types or detection signal current $I_S$ at the timing of state Nos. 6 and 4 as shown in FIG. 8. In the meantime, the steady-state current $I_O$ immediately before the current by sensor types or the detection signal current $I_S$ has been received is detected at the timing of state No. 3. And when the current by sensor types or the detection signal current $I_S$ has been received, the difference from the steady-state current $I_O(I_S-I_O)$ is computed and the types of the sensors in the respective fire detectors or unusual condition such as occurrence of a fire is determined based on the result of the computation of $(I_S-I_O)$ (FIG. 10**(*b*)).

In FIG. 8, current detection is carried out with respect to only one detecting means selected preliminarily. However, the respective fire detector 4*a* to 4*n* has a plurality of detecting means 5 to 8 as illustrated in FIG. 2, and if the calling and detection are carried out with respect to all of the detecting means 5 to 8, the generation timing of the calling clock pulses from the calling control circuit 14 may be adjusted to provide an extra time and allot the extra time to the states for the detection with respect to the detecting means 5 to 8.

Figure 11:
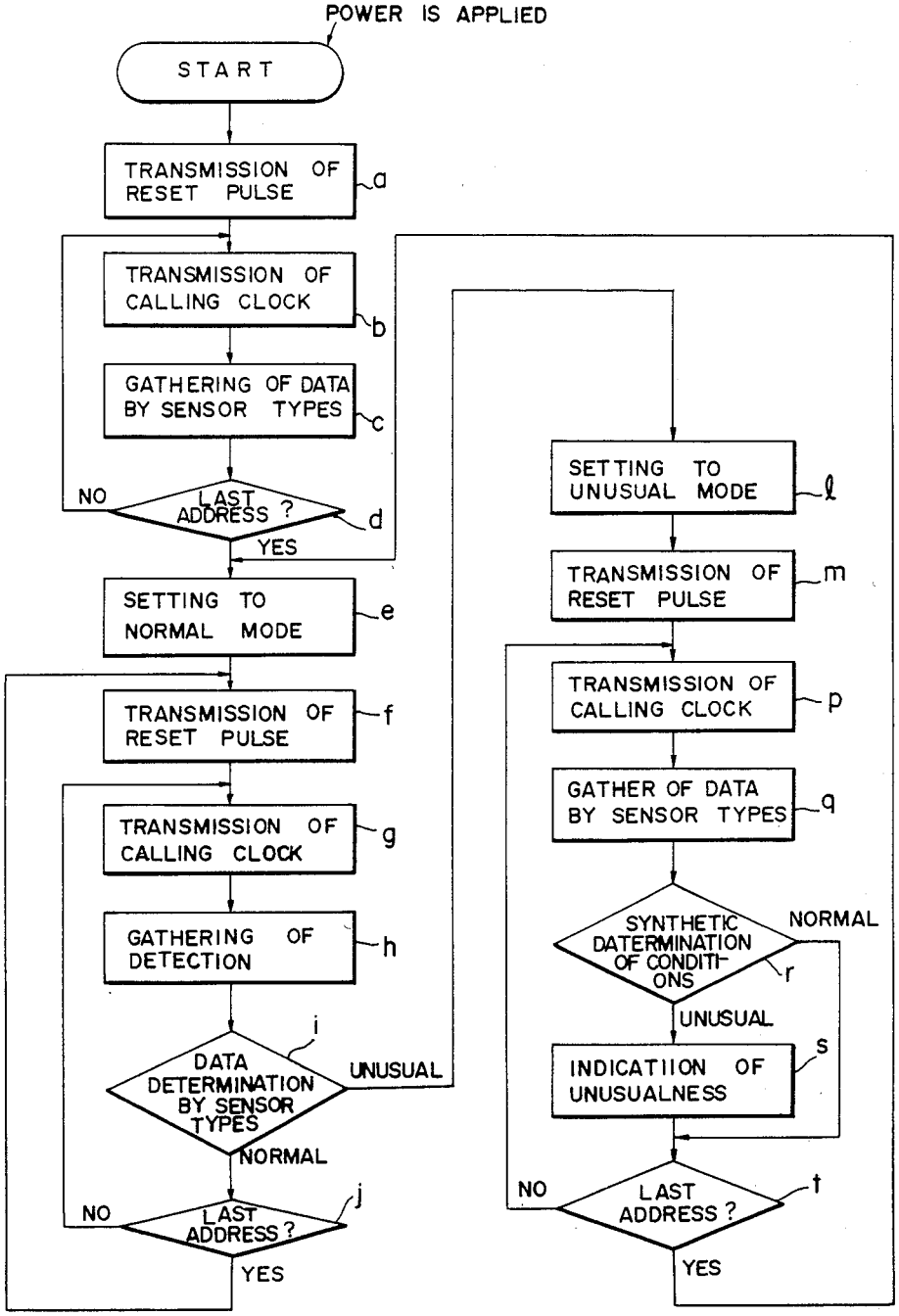
FIGS. 11(*a*) and (*b*) is a time chart showing the data gathering procedures of the fire detector.
Figure 11:
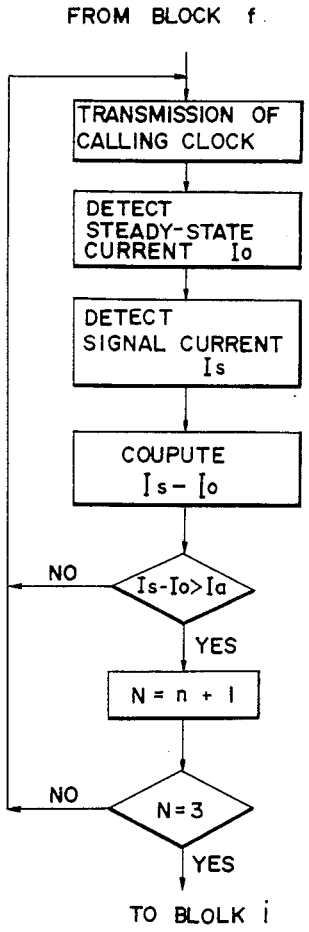
Figure 13:
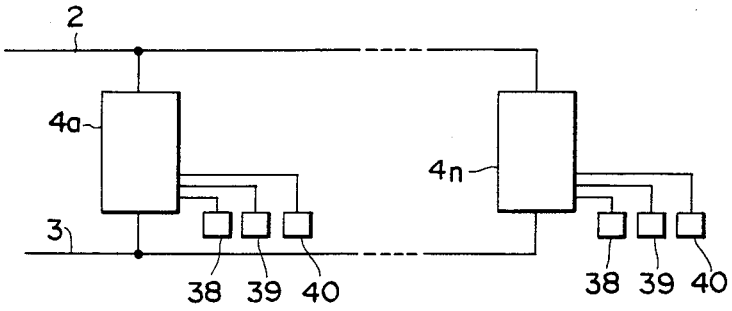
FIG. 13 is a block diagram showing the connection of the equipments to be controlled to the fire detector.
Figure 14:
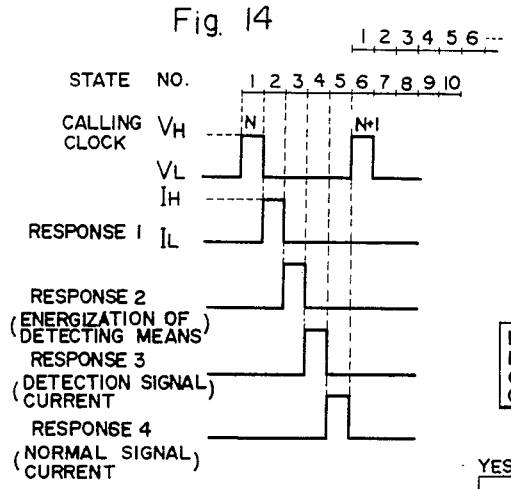
FIG. 14 is a timing chart showing the response of the fire detector to the central signal station.
Figure 15:
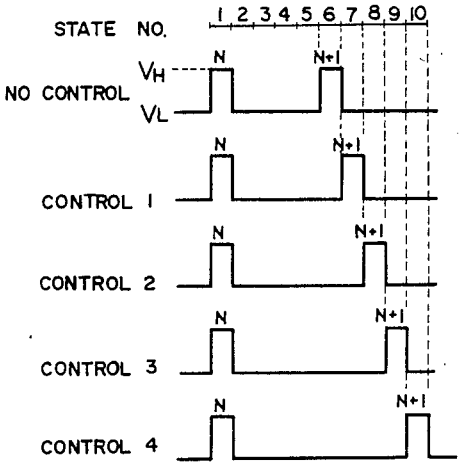
FIG. 15 is a timing chart showing the control instruction for the transmission control in the example of FIG. 14.
Figure 16:
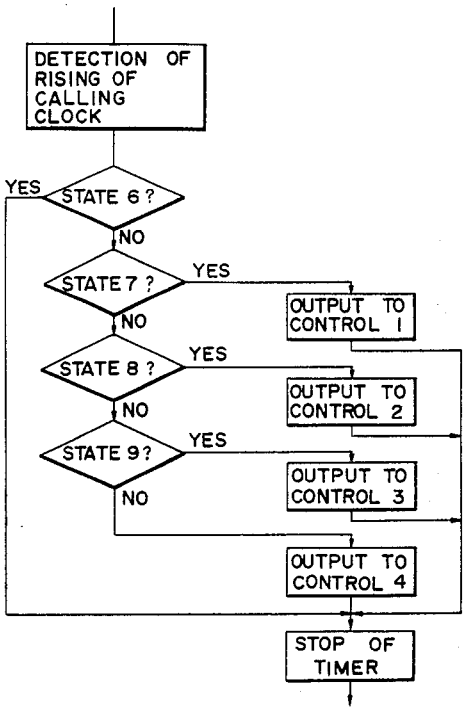
FIG. 16 is a flowchart of the transmission control as in the example of FIG. 14.

Referring now to FIGS. 8 to 12(*a*) and (*b*), the operation is described according to the procedure of the processing by the microcomputer 10 as shown in FIG. 11. When the power source 15 of the central signal station 1 is turned on, the control means 31 of the microcomputer 10 instructs the calling control circuit 14 to effect the transmission control through the signal processing means 32 and a reset pulse is transmitted at block a. Each of the fire detectors 4*a* to 4*n* is initialized by the reset pulse. When the first calling clock pulse is transmitted at block b, for example, the fire detector 4*a* recognizes that it is called and returns the signal current by sensor types of the detecting means connected thereto in the mode of current. At this time, the steady-state current, the detection signal current and the normal signal current are also transmitted, but detection of these current is at the discretion of the user. At block c, the information by sensor types determining means 33 of the microcomputer 10 determines the types of the mechanisms of the detecting means and the number thereof so as to be stored in the memory RAM and sets the reference for the fire detection determination corresponding to the sensor types of the detecting means. At block d, the last address n is recognized and the gathering of the data by sensor types is completed.

After completion of gathering of the data by sensor types, instruction is transmitted to the calling circuit 14 to gather the detection data in a normal mode at block e and a second reset pulse is transmitted at block f to again initialize the fire detectors 4*a* to 4*n*. The signal processing sections 28 and 30 are put into a condition capable of transmitting the analog detection data.

In this connection, it is to be noted that the control circuit 17 calls the sensor circuits 20 and 21 sequentially. More specifically, the control circuit 17 applies a calling signal to a calling output terminal A of the sensor circuit 20 to call the sensor circuit 20 and the sensor circuit 20 responds thereto to output signal current corresponding to, for example, the states Nos. 1 to 6. Thereafter, the control circuit 17 applies a calling signal to a calling output terminal C of the sensor circuit 21 to call the sensor circuit 21 and the sensor circuit 21 outputs signal current corresponding, for example, to states Nos. 1 to 10 in response to the calling. The states Nos. 7 to 10 are for the control as will be described later.

Hereinafter there will be described a case wherein the control circuit 17 calls only one sensor circuit preliminarily selected as the representative to produce an output at the normal time and it calls all the sensor circuits included in the fire detector which has detected the unusual condition. In this case, the priority order is determined by determining which sensor circuit 20 or 21 is called by the control circuit 17, or the sensor circuit connected to the calling output terminal A which is first called by the control circuit 17 is representatively called.

At a normal time, when the first calling clock is transmitted at block g, the control circuit of the corresponding fire detector recognizes that it is called and returns the detection data of the sensor circuit having the priority. More particularly, at state No. 3 as shown in FIG. 8, the basic current $I_O$ of the photoelectric type fire detector 6 is returned in the form of an analog value as the steady-state current, and at state No. 4, the detection signal current $I_S$ and at state No. 5, a normal signal current representing the normal connection are returned in the form of analog values. At block h, the difference between the currents $I_O$ and $I_S$ is computed and at block i, the result of the computation is compared with the determination reference preliminarily set for the respective types of the detecting means to determine the detection data is of a fire. The details of block h is as shown in FIG. 11(*b*), and the detection of the currents $I_O$ and $I_S$ and the computation of the difference between the currents are repeated three times if the difference $I_S-I_O$ exceeds the determination reference value $I_a$. And if no unusualness is recognized, the operation as described above is repeated until the last address n. When reaching the last address n, a reset pulse is again transmitted to repeat the detection as mentioned above.

In this connection, if a fire is recognized from the detection data, the detection mode is changed into an unusual mode by the control means 31 of the microcomputer 10 (block l) and a reset pulse is transmitted from the calling control circuit 14 (block m). If the fire alarm 4*a* detects a fire, a time twice the normal returning time of the sensor circuit, i.e. an additional returning time is given to the fire detector 4*a* for transmission timing of the calling clock at block p. This is accomplished by a data gathering control means 37. With respect to the remaining fire detectors 4*b* to 4*n*, the sensor circuits representing them respectively are called. In the embodiment as illustrated, at an unusual time, state No. 5 is also omitted in the respective fire detectors 4*a* to 4*n* to adjust the free time for shortening the detection period and for gathering further data.

At block r, the types of the detecting means and the detection data are comprehensively determined. For example, if both the difference $(I_S-I_O)$ between the basic current $I_O$ of the photoelectric type smoke sensor 6 and the detection signal current $I_S$ and the difference between the basic current $I_O$ of the ionization type smoke sensor 5 and the detection signal current $I_S$ exceed the determination reference levels preliminarily set for the respective sensors, unusual condition is determined to actuate the alarm circuit for giving an alarm. Determination is made not only as to whether the difference from the detection signal current $I_S$ exceeds the threshold value, i.e. the reference value $I_a$ but as to the change of the difference value (see FIG. 10(*a*)) to synthetically determine spreading or reduction of the fire.

Alternatively, all of the detecting means 5 to 8 of the respective fire detectors may be called to improve reliability of the information when one of the fire detectors 4a to 4n detects unusual condition.

As described above, the cycle of the calling clock may be varied so as to change the intervals of the calling clock pulses to provide an extra time and increase the number of states. An embodiment of the present invention wherein states Nos. 6 to 10 are used for transmission control with respect to the respective fire detectors 4a to 4n will now be described.

FIGS. 13 to 16 illustrate control instruction to the fire detectors 4a to 4n in connection with a N-th calling pulse. The control instruction to the fire detectors 4a to 4n is carried out by the transmission of the N+1th calling clock at the timing of states Nos. 6 to 10. When no control instruction is made, the N+1th calling clock is generated at a timing of state No. 6. On the other hand, when control is instructed, N+1th calling clock is generated at a timing of any one of the states No. 7 to 10. In an embodiment as illustrated, control instructions are given independently of each other to four equipments to be controlled by changing the generation timing of the N+1th calling clock succeeding the N-th calling clock in such a manner that four kinds of control instructions, i.e., control 1, control 2, control 3 and control 4 are output at state No. 7, state No. 8, state No. 9 and state No. 10, respectively. As examples of the equipments to be controlled, there can be mentioned an exhaust system 38, a LED 39 for operation check of the fire detectors 4a to 4n, a LED 40 as a pilot lamp for confirming the operation of the fire detectors, and so on. Each of the states are independent of each other and the controls 1 to 4 may be combined. For example, if control instruction is determined for the control 4, i.e. the exhaust system 38 upon receipt of a fire signal, since the control 4 corresponds to state No. 10, a calling clock to the second fire detector 4b is generated at the timing of state No. 10, and the state timing of the calling clock generated at the timing of state No. 10 is determined by the detector 4a to operate the exhaust system 38.

The control instruction to the n-th, i.e. the last detector 4n will be described by way of example referring to the control instruction of control 4. As illustrated, at the timing of state No. 10 corresponding to the control 4, a reset pulse is generated instead of the calling clock and the n-th detector 4n determines that the reset pulse is obtained at the timing of state No. 10 to generate a control output corresponding to the control 4.

Although three equipments to be controlled 38 to 40 are illustrated in the above-mentioned example, desired number of response and control instruction can be effected by selecting the number of states following the calling clock, according to the number of the detecting means 5 to 8 and the equipments to be controlled 38 to 40.

We claim:

1. A fire alarm system having a plurality of fire detectors connected in parallel with each other to signal lines leading to a central signal station for detecting a change in the ambient physical phenomena caused by a fire and responding to the station with the detection signal, which system is characterized in that said signal lines connecting to the respective fire detectors are also used as power lines;

each of said fire detectors receives calling clock pulses superposed on a power supply voltage and transmitted from the central signal station through the power/signal lines and returns the detection signal in the mode of current to the signal station; and said central signal station comprises:

a calling control means which outputs the calling clock pulses by transmitting one calling clock pulse to one fire detector and providing, between the calling clock pulses, a time for detecting at least a steady-state current and a time for detecting the detection signal current;

a current detecting means for detecting the steady-state current and the detection signal current;

a computing means for obtaining a difference between the steady-state current and the detection signal current; and an alarm means for giving an alarm upon determination of a fire based on the output value from the computing means.

2. A fire alarm system according to claim 1, wherein said current detecting means detects the steady-state current immediately before it detects the detection signal currents from the respective fire detectors.

3. A fire alarm system according to claim 1, wherein said central signal station outputs the calling clock pulses through the calling control means thereof by providing a time for detecting a signal current by sensor types representing the type of detecting means included in the respective fire detectors, at an interval between the calling clock pulses and it further comprises a data by sensor types determining means which detects the signal current by sensor types through the current detecting means for computing a difference between the steady-state current and the signal current by sensor types by the computing means to determine the data by sensor types and sets fire determining references according to the data by sensor types; and each of said fire detector comprises:

a calling determining means which counts the calling clock pulses from the central signal station for determining when called by the signal station;

a data by sensor types output means for transmitting data by sensor types set at different predetermined levels by the types of the detecting means included in the respective fire detectors; and a detection information transmitting means for transmitting the data signal current detected by the respective fire detectors when called by the signal station, in the mode of current.

4. A fire alarm system according to claim 3 wherein said calling control means of the central signal station accomplishes the determination of the signal current returned from the fire detector in response to the calling thereto in such a manner that the determination with respect to the signal current by sensor types is made prior to the determination with respect to the detection signal current and the data by sensor types is stored in a storing section.

5. A fire alarm system according to claim 1, 2, 3 or 4 wherein the detection signal current returned from the fire detector to the central signal station upon detection by the detector is analog data.

6. A fire alarm system according to claim 1 or 3 wherein said calling control means of the central signal station outputs the calling clock pulses in such a manner that an extra time is provided in addition to the time for detecting the various currents of the detector at an interval between the clock pulses transmitted therefrom, said extra time being determined according to one or more objects to be monitored/controlled in association with the fire detector and the timing of the extra time being adjusted according to the contents of the control with respect to the object or objects.

7. A fire alarm system according to claim 6 wherein the adjustment of the timing of the extra time is attained by adjusting the extra time by changing the timing of transmission of the calling clock pulses from the calling control means of the central signal station.

8. A fire alarm system according to claim 7 wherein said objects are a plurality of detecting means included in the fire detector and said calling control means calls, at a normal time, only one detecting means preliminarily determined as a representative of the respective fire detector and calls, at an unusual time, all the detecting means included in the fire detector which detects unusualness.

9. A fire alarm system according to claim 7 wherein said objects are a plurality of detecting means included in the respective fire detector and the calling control means calls, at a normal time, all the detecting means and calls, at an unusual time, only one detecting means preliminarily determined as the representative of the respective fire detectors other than the fire detector which has detected the unusualness.

10. A fire alarm system according to claim 7 wherein said object or objects is or are one or more detecting means or one or more equipments connected to the respective fire detector.

* * * * *